US010522894B2

(12) United States Patent
Nishihara et al.

(10) Patent No.: US 10,522,894 B2
(45) Date of Patent: Dec. 31, 2019

(54) COAXIAL LINE TO MICROSTRIP LINE CONVERSION CIRCUIT, WHERE THE CONVERSION CIRCUIT COMPRISES A WAVEGUIDE IN WHICH THE COAXIAL LINE AND THE MICROSTRIP LINE ARE DISPOSED

(71) Applicant: Mitsubishi Electric Corporation, Chiyoda-ku (JP)

(72) Inventors: Jun Nishihara, Chiyoda-ku (JP); Hiroyuki Nonomura, Chiyoda-ku (JP); Toshihiro Fujii, Chiyoda-ku (JP)

(73) Assignee: Mitsubishi Electric Corporation, Chiyoda-ku (JP)

( * ) Notice: Subject to any disclaimer, the term of this patent is extended or adjusted under 35 U.S.C. 154(b) by 0 days.

(21) Appl. No.: 15/565,563

(22) PCT Filed: May 18, 2016

(86) PCT No.: PCT/JP2016/064756

§ 371 (c)(1),
(2) Date: Oct. 10, 2017

(87) PCT Pub. No.: WO2016/186136

PCT Pub. Date: Nov. 24, 2016

(65) Prior Publication Data

US 2018/0123210 A1 May 3, 2018

(30) Foreign Application Priority Data

May 19, 2015 (JP) ..... 2015-101784

(51) Int. Cl.
*H01P 5/08* (2006.01)
*H01P 5/107* (2006.01)
(Continued)

(52) U.S. Cl.
CPC ..... *H01P 5/085* (2013.01); *H01P 3/06* (2013.01); *H01P 3/081* (2013.01); *H01P 5/103* (2013.01); *H01P 5/107* (2013.01)

(58) Field of Classification Search
CPC .. H01P 5/107; H01P 5/085; H01P 5/08; H01P 5/103
(Continued)

(56) References Cited

U.S. PATENT DOCUMENTS 4,463,324 A * 7/1984 Rolfs ..... H01P 5/103 333/26
4,901,040 A 2/1990 Ahlborn et al.
(Continued)

FOREIGN PATENT DOCUMENTS

JP 60-247302 A 12/1985
JP 2-36202 U 3/1990
(Continued)

OTHER PUBLICATIONS

International Search Report dated Jul. 26, 2016 in PCT/JP2016/064756 filed May 18, 2016.
(Continued)

*Primary Examiner* — Benny T Lee
(74) *Attorney, Agent, or Firm* — Oblon, McClelland, Maier & Neustadt, L.L.P.

(57) ABSTRACT

A coaxial microstrip line conversion circuit includes: a waveguide including first and second through holes, spaced apart from each other, the second through hole having a dimension to cut off a used frequency; a coaxial connector including a central conductor including a projection projecting from an axial end of an outer conductor; and a microstrip line including a ground conductor provided on one surface of an insulating substrate, and a strip line provided on the other surface of the insulating substrate and including a projection projecting axially from the ground conductor. The outer conductor is connected to an outer wall of the waveguide. The projection of the central conductor is inserted through the first through hole into the waveguide, the ground conductor is connected to an inner wall of the second
(Continued)

through hole, and the projection of the strip line is inserted through the second through hole into the waveguide.

14 Claims, 12 Drawing Sheets

(51) Int. Cl.
*H01P 5/103* (2006.01)
*H01P 3/06* (2006.01)
*H01P 3/08* (2006.01)

(58) Field of Classification Search
USPC ..... 333/26
See application file for complete search history.

(56) References Cited

U.S. PATENT DOCUMENTS 7,002,431 B2 * 2/2006 Lenz et al. ..... H01P 5/107 333/26
7,479,842 B2 * 1/2009 Gaucher et al. ..... H01P 3/003 333/246
2007/0182505 A1 8/2007 Fujita et al.

FOREIGN PATENT DOCUMENTS

| | | | |
|---|---|---|---|
| JP | 2-288501 | A | 11/1990 |
| JP | 5-259713 | A | 10/1993 |
| JP | 8-293706 | A | 11/1996 |
| JP | 2007-214777 | A | 8/2007 |
| JP | 2007-258886 | A | 10/2007 |
| JP | 2011-120155 | A | 6/2011 |

OTHER PUBLICATIONS

Notice of Grounds of Rejection dated Dec. 6, 2016 in Japanese Patent Application No. 2016-558236 (with English language translation).

* cited by examiner

A-A' CROSS-SECTION

B-B' CROSS-SECTION

A-A' CROSS-SECTION

B-B' CROSS-SECTION

COAXIAL LINE TO MICROSTRIP LINE CONVERSION CIRCUIT, WHERE THE CONVERSION CIRCUIT COMPRISES A WAVEGUIDE IN WHICH THE COAXIAL LINE AND THE MICROSTRIP LINE ARE DISPOSED

TECHNICAL FIELD

The present disclosure relates to a coaxial microstrip line conversion circuit for use in an input/output section of an electronic device such as a microwave or millimeter-wave band radar device, communication equipment.

BACKGROUND ART

In an electronic device such as a radar device or communication equipment, a coaxial connector is widely used as an input/output interface for a high-frequency signal. A strip line including a microstrip line is widely used as means for propagating a high-frequency signal within an electronic device.

As a method of connecting a coaxial connector and a microstrip line, Japanese Utility Model Laying-Open No. 2-36202 describes in FIG. 1 (see PTD 1 below) a configuration in which a connector core of a coaxial connector and a microstrip line are connected by a gold ribbon.

However, considering the deformation caused by a difference in linear expansion during temperature change between a housing to which the coaxial connector is attached and a substrate on which the microstrip line is formed, a gap is provided between the housing and the substrate as shown in FIG. 2 of PTD 1. Thus, there is a concern about leakage of a high-frequency signal (electric wave) through this gap.

As means for solving this problem, a method has been used of directly connecting a central conductor of a coaxial connector and a microstrip line in a closed space, as in FIGS. 1 and 2 of Japanese Patent Laying-Open No. 5-259713 (see PTD 2 below).

CITATION LIST

Patent Documents

PTD 1: Japanese Utility Model Laying-Open No. 2-36202 (FIGS. 1 and 2)
PTD 2: Japanese Patent Laying-Open No. 5-259713 (FIGS. 1 and 2)

SUMMARY OF THE INVENTION

Technical Problem

However, the method described in PTD 2 is problematic because the central conductor of the coaxial connector, a dielectric substrate are deformed due to temperature change, causing stress concentration at a connection between the central conductor of the coaxial connector and the microstrip line, thereby resulting in breakage.

The present disclosure has been made in order to solve the problem as described above, and an object of the present disclosure is to provide a coaxial microstrip line conversion circuit that connects a coaxial connector and a microstrip line, in which leakage of a high-frequency signal through a gap between a housing and a substrate is eliminated, and in which stress is not produced at a connection between the coaxial connector and the microstrip line, thereby improving the reliability of this connection.

Solution to the Problem

A coaxial microstrip line conversion circuit according to the present disclosure includes: a waveguide having a first through hole, and a second through hole spaced apart from the first through hole and having such a dimension as to cut off a transmission frequency; a coaxial line having an outer conductor, a central conductor having a projection extending beyond an axial end of the outer conductor, and an insulator provided between the outer conductor and the central conductor; and a microstrip line having a ground conductor provided on one surface of an insulating substrate, and a strip line provided on the other surface of the insulating substrate opposite to the one surface and having a projection extending beyond an edge of the ground conductor. In the coaxial line, the outer conductor is connected to an outer wall of the waveguide, and the projection of the central conductor is inserted through the first through hole into the waveguide. In the microstrip line, the ground conductor is connected to an inner wall of the second through hole, and the projection of the strip line is inserted through the second through hole into the waveguide.

Advantageous Effects of the Invention

In a coaxial microstrip line conversion circuit of the present disclosure, since a coaxial line and a microstrip line are connected through a waveguide section, leakage of a high-frequency signal through a gap between a housing and a substrate is eliminated, and stress is not produced at a connection between a coaxial connector and the microstrip line, thereby improving the reliability of an electronic device.

DETAILED DESCRIPTION OF THE EMBODIMENTS

Figure 1A:
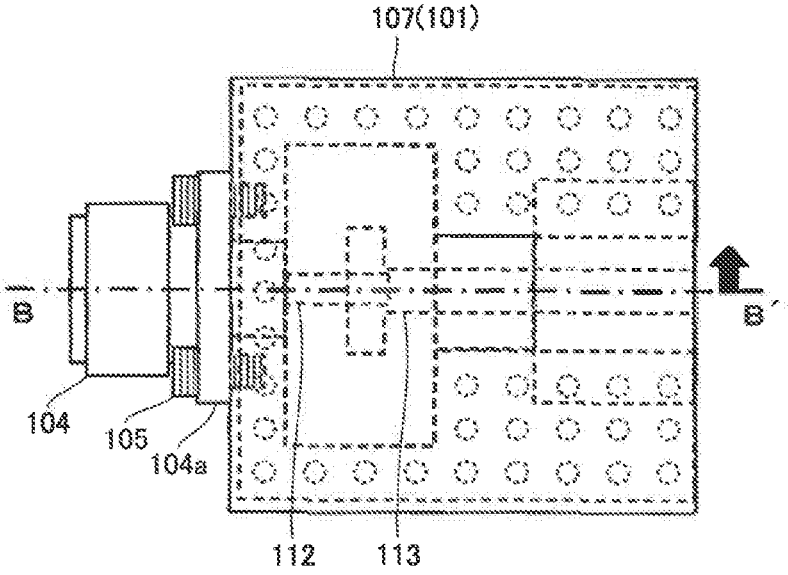
FIG. 1A is a diagram illustrating the configuration of a coaxial microstrip line conversion circuit according to a first embodiment of the present disclosure.
Figure 1B:
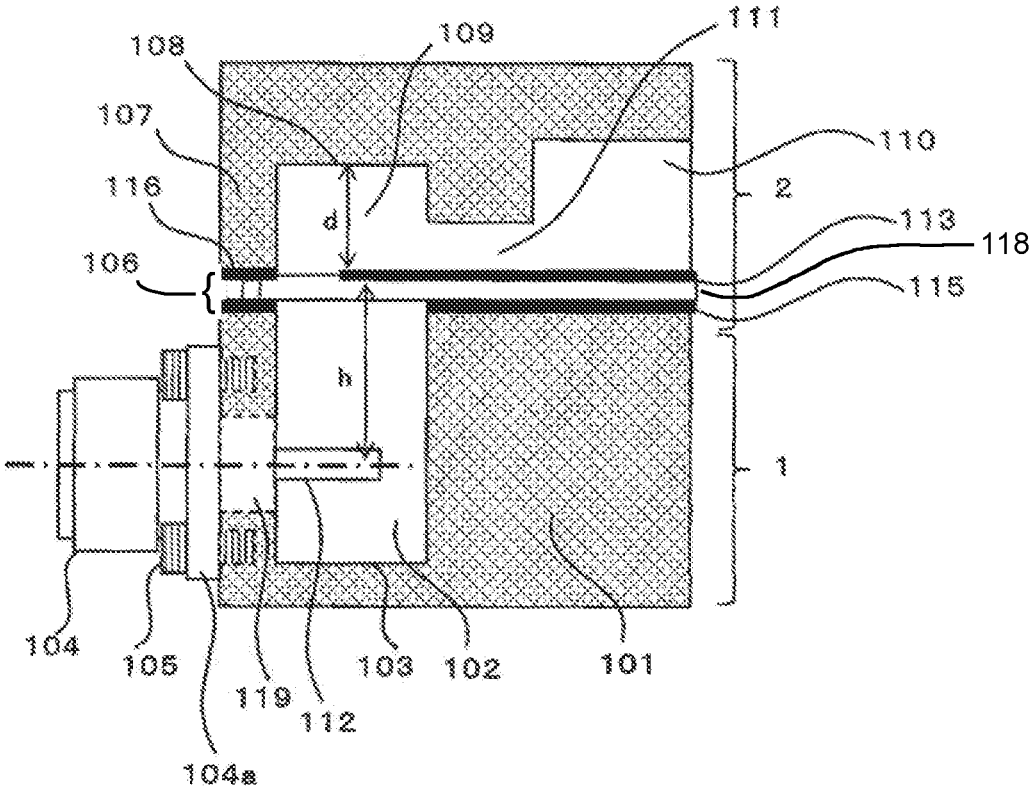
FIG. 1B is a cross-sectional view along B-B' of FIG. 1A.
Figure 2A:
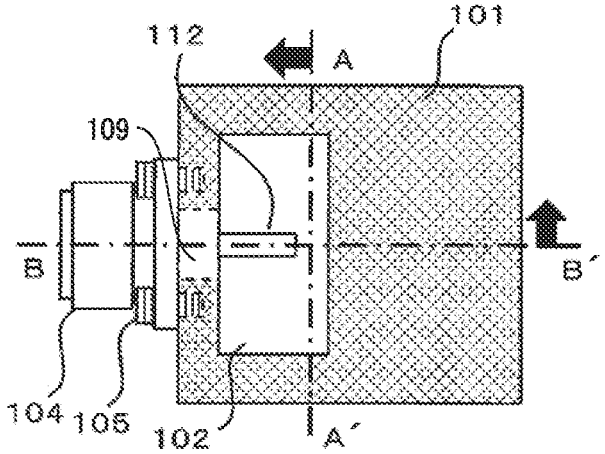
FIG. 2A is a top view of a coaxial waveguide converter of the coaxial microstrip line conversion circuit according to the first embodiment of the present disclosure.
Figure 2B:
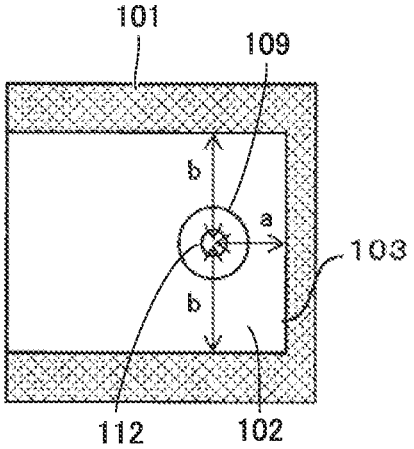
FIG. 2B is a cross-sectional view along A-A' of FIG. 2A.
Figure 2C:
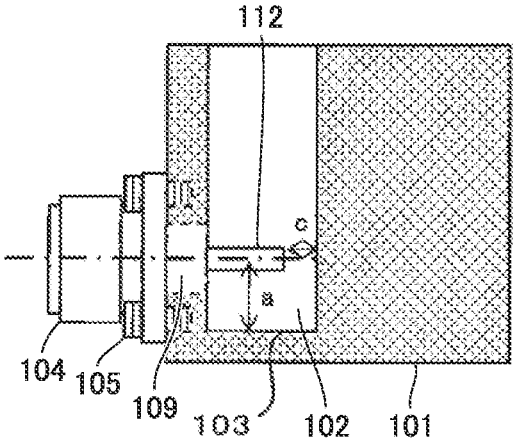
FIG. 2C is a cross-sectional view along B-B' of FIG. 2A.

In all embodiments of the present disclosure, reference to both FIGS. 1 A and 1B may be represented as FIG. 1, and reference to all of FIGS. 2A, 2B and 2C may be represented as FIG. 2. The same applies to the other figures. The same element is labeled throughout the figures with the same reference numeral.

First Embodiment

A first embodiment of the present disclosure will now be described using FIG. 1. FIG. 1 is a diagram illustrating the configuration of a coaxial microstrip line conversion circuit according to the first embodiment of the present disclosure. In FIG. 1, FIG. 1A is a top view of the coaxial microstrip line conversion circuit according to the first embodiment of the present disclosure, and FIG. 1B is a cross-sectional view along B-B' of FIG. 1A.

The coaxial microstrip line conversion circuit according to the first embodiment of the present disclosure includes a waveguide section formed of: a first waveguide 102 having a coaxial connector insertion hole 119 serving as a first through hole; and a second waveguide 109 having a microstrip line insertion hole 111 serving as a second through hole which is spaced apart from coaxial connector insertion hole 119 and which has such a dimension as to cut off a transmission frequency, as illustrated in FIG. 1B. The coaxial microstrip line conversion circuit further includes a coaxial connector 104 having: an outer conductor; a central conductor 112 having a projection extending beyond an axial end of the outer conductor; and an insulator provided between the outer conductor and central conductor 112. The coaxial microstrip line conversion circuit further includes a substrate 106 (FIG. 1B) having a microstrip line formed of: a ground conductor 115 (FIG. 1B) provided on one surface of a dielectric substrate 118; and a signal line 113 provided on the other surface of insulating dielectric substrate 118 opposite to the one surface, and formed of a strip line having a projection extending beyond an edge of ground conductor 115. Conductor 116 is formed on the same plane as signal line 113.

At coaxial connector 104 serving as a coaxial line, a flange 104*a*, which is the outer conductor, is connected by a screw 105 to an outer wall of first waveguide 102 around coaxial connector insertion hole 119, and the projection of central conductor 112 is inserted through coaxial connector insertion hole 119 into first waveguide 102 of the waveguide section. Substrate 106 having the microstrip line has ground conductor 115 connected to an inner wall of microstrip line insertion hole 111. The projection of signal line 113 formed of the strip line is inserted through microstrip line insertion hole 111 into second waveguide 109 serving as the waveguide section. Ground conductor 115 is not inserted into second waveguide 109, and only the projection of signal line 113 is inserted into second waveguide 109. Here, coaxial connector insertion hole 119 is provided in the outer wall of the H plane of first waveguide 102. Microstrip line insertion hole 111 is provided in an outer wall of the H plane of second waveguide 109. Coaxial connector insertion hole 119 and microstrip line insertion hole 111 are spaced apart from each other in a waveguide axis direction of the waveguide section formed of first waveguide 102 and second waveguide 109.

The coaxial microstrip line conversion circuit according to the first embodiment of the present disclosure is characterized by being broadly formed of a coaxial line-waveguide converter 1 and a waveguide-microstrip line converter 2, as illustrated in FIG. 1B. In coaxial line-waveguide converter 1, a first housing 101 made of a conductive material such as resin plated with a metal or metal material such as aluminum or stainless steel has first waveguide 102 formed therein, where first waveguide 102 has a shorting plate 103 (FIG. 1B) at its one end in the waveguide axis direction. Coaxial connector 104 is fixed to first housing 101 by screw 105. In contrast, waveguide-microstrip line converter 2 is formed of substrate 106 having the microstrip line, and a second housing 107. Similarly to first housing 101, second housing 107 is made of a conductive material such as resin plated with a metal or metal material such as aluminum or stainless steel. Second housing 107 has: second waveguide 109 being identical to first waveguide 102 in cross-sectional shape when viewed in the waveguide axis direction, and having a shorting plate 108 (FIG. 1B) at its one end in the waveguide axis direction; and microstrip line insertion hole 111 having such a dimension as to cut off a used frequency in order to obtain electrical isolation from an electronic device internal space 110 (FIG. 1B). In other words, microstrip line insertion hole 111 has such a dimension that the propagation of a high-frequency signal of a used frequency through the space portion of microstrip line insertion hole 111 in a waveguide mode is suppressed. Since the high-frequency signal of the used frequency is transmitted through microstrip line insertion hole 111 on the microstrip line formed on substrate 106 having the microstrip line, there are no problems with the transmission of the high-frequency signal.

Spatial isolation in a transmission (propagation) direction of the high-frequency signal in microstrip line insertion hole 111 is simply expressed by the following equation (1). The transmission (propagation) direction of the high-frequency signal in microstrip line insertion hole 111 is a direction that connects an opening at the second waveguide 109 side and an opening at the electronic device internal space 110 side of microstrip line insertion hole 111.

[Mathematical 1]

$$\alpha = \frac{54.6}{\lambda c}\sqrt{1-\left(\frac{\lambda c}{\lambda}\right)^2} \quad (1)$$

where $\alpha$ represents the amount of spatial isolation [dB/mm] per unit length, $\lambda c$ represents the wavelength [mm] of a cutoff frequency, and $\lambda$ represents the wavelength [mm] of a transmission frequency.

In the equation (1), wavelength $\lambda c$ of the cutoff frequency in microstrip line insertion hole 111 is determined by the space in a direction orthogonal to the direction in which the high-frequency signal proceeds, that is, the space between opposed wall surfaces within microstrip line insertion hole 111. Thus, the wavelength of the cutoff frequency is expressed as $\lambda c$=2×"the space in a direction orthogonal to the direction in which the high-frequency signal proceeds, that is, the space between opposed wall surfaces within microstrip line insertion hole 111." Here, the cutoff frequency is determined as fc=light speed/$\lambda c$. Accordingly, in order to maximize the amount of spatial isolation per unit length, it is important to reduce the space between the opposed wall surfaces within microstrip line insertion hole 111.

FIG. 2 shows details of coaxial line-waveguide converter 1. FIG. 2 is a diagram illustrating the configuration of a coaxial waveguide converter of the coaxial microstrip line conversion circuit according to the first embodiment of the present disclosure. FIG. 2A is a top view of the coaxial waveguide converter of the coaxial microstrip line conversion circuit according to the first embodiment of the present disclosure, FIG. 2B is a cross-sectional view along A-A' of FIG. 2A, and FIG. 2C is a cross-sectional view along B-B' of FIG. 2A. Central conductor 112 of coaxial connector 104 (FIGS. 2A and 2C) is disposed at a distance a from shorting plate 103 (FIGS. 1B and 1C), and centered on a central position b of a longitudinal dimension of the waveguide cross section. Central conductor 112 is disposed at a distance c (FIG. 2C) from an inner wall of first waveguide 102. Distances a (FIGS. 2B and 2C), b (FIG. 2B) and c (FIG. 2C) are optionally set so as to provide an optimal impedance at a used frequency.

Figure 3A:
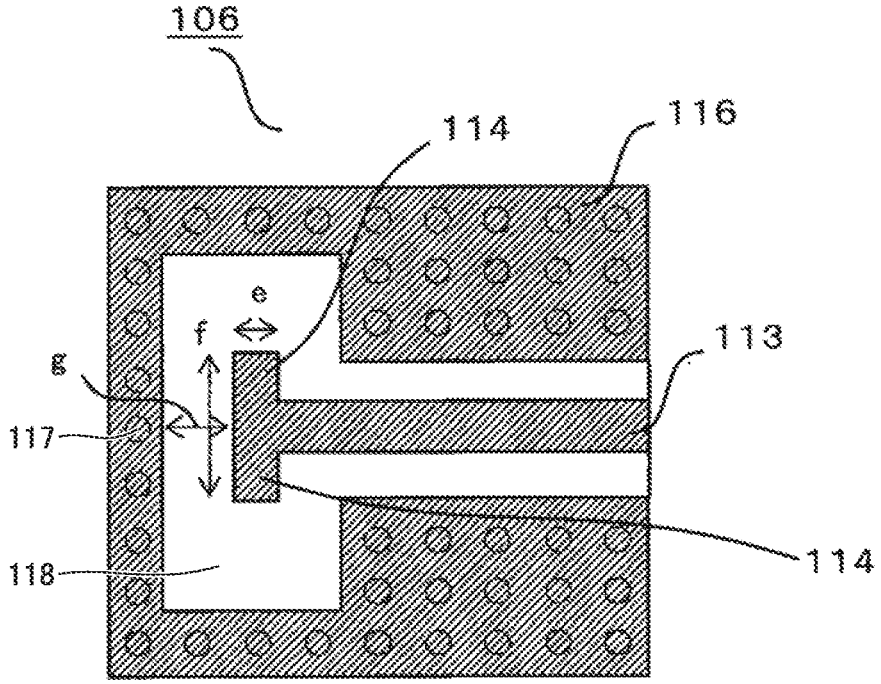
FIG. 3A is a view from above of a substrate having a microstrip line of the first embodiment of the present disclosure.
Figure 3B:
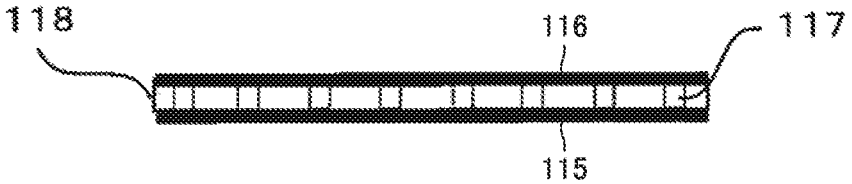
FIG. 3B is a view from the side of the substrate having the microstrip line of the first embodiment of the present disclosure.
Figure 3C:
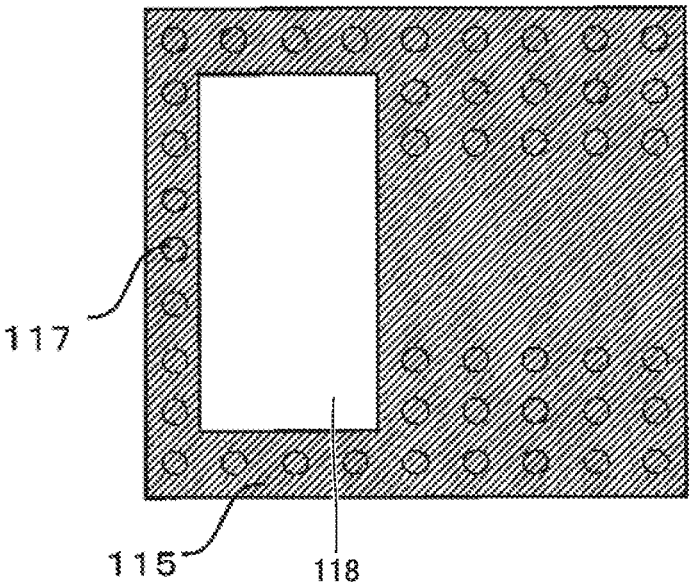
FIG. 3C is a view from below of the substrate having the microstrip line of the first embodiment of the present disclosure.

FIG. 3 shows details of substrate 106 (FIG. 3A) having the microstrip line. FIG. 3 is a diagram illustrating the substrate having the microstrip line of the coaxial microstrip line conversion circuit according to the first embodiment of the present disclosure. FIG. 3A is a view from above of the substrate having the microstrip line of the first embodiment, FIG. 3B is a view from the side of the substrate having the microstrip line of the first embodiment, and FIG. 3C is a view from below of the substrate having the microstrip line of the first embodiment. Signal line 113 (FIG. 3A) formed of the strip line is disposed on dielectric substrate 118, and a tip 114 (FIG. 3A) of signal line 113 is T-shaped so as to have favorable reflection characteristics across a wide band at a used frequency. Ground conductor 115 (FIGS. 3B and 3C) disposed on a rear surface of signal line 113 and a conductor 116 (FIG. 3A) formed on the same plane as signal line 113 are connected by through holes 117, and conductor 116 (FIG. 3B) also functions as a ground conductor. By optionally setting distances e, f, g of FIG. 3 and a distance d of FIG. 1B, an optimal impedance is provided at a used frequency.

Since ground conductor 115 and conductor 116 (FIG. 3B) of substrate 106 having the microstrip line are connected by through holes 117, first housing 101 and second housing 107 are electrically connected, and the space formed by first waveguide 102 and second waveguide 109 serves as an electrically closed space, as shown in FIGS. 1 and 2.

Figure 4:
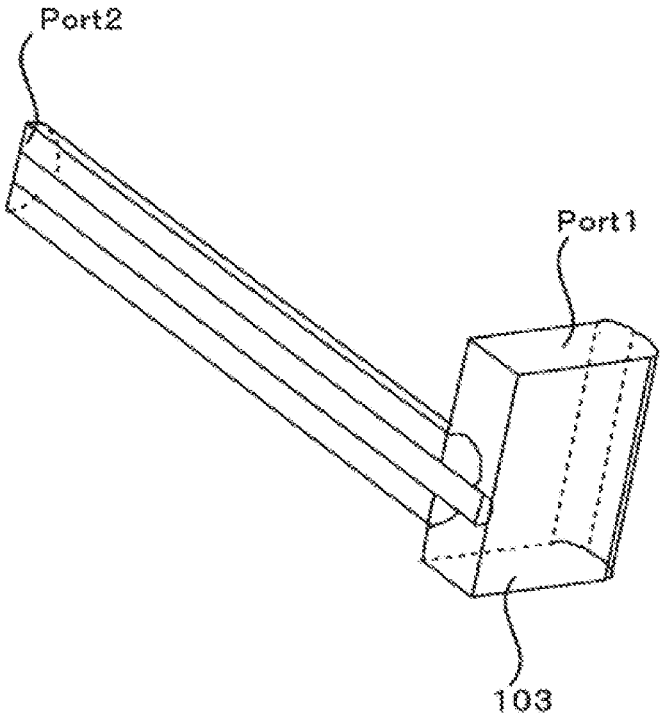
FIG. 4 is a diagram illustrating a simulation model of the coaxial waveguide converter of the coaxial microstrip line conversion circuit according to the first embodiment of the present disclosure.
Figure 5:
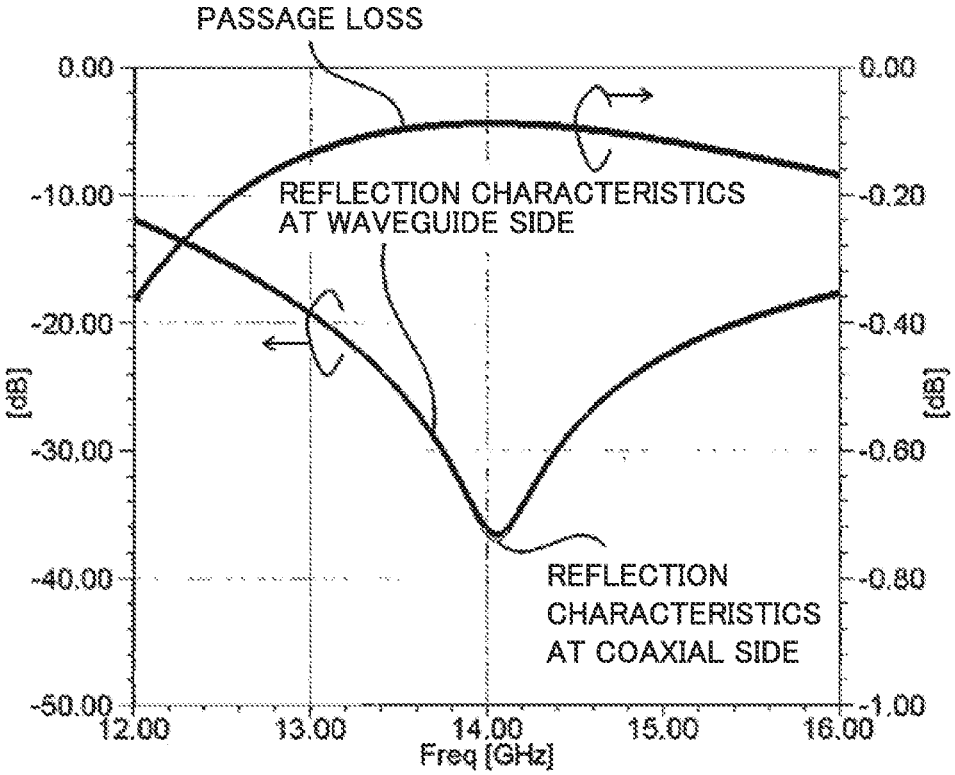
FIG. 5 is a diagram illustrating simulation results of the simulation model of FIG. 4.

FIGS. 4 and 5 show an electromagnetic field calculation model of coaxial line-waveguide converter 1 of FIG. 1 and calculation results. FIG. 4 is a diagram illustrating a simulation model of the coaxial waveguide converter of the coaxial microstrip line conversion circuit according to the first embodiment of the present disclosure. Shorting plate 103 is indicated for reference. FIG. 5 is a diagram illustrating simulation results of the simulation model of FIG. 4. In FIG. 4, the electromagnetic field calculation model employs the cross section along B-B' of FIG. 1 as a symmetrical boundary in order to shorten the calculation time. Dimensional data was determined so as to attain favorable reflection characteristics of less than −20 dB within the range of between 13.75 GHz and 14.5 GHz. In FIG. 5, the PASSAGE LOSS curve shows the GHz frequency characteristics of the loss amount in dB of the high-frequency signal passing between Port 1 and Port 2 in FIG. 4. The REFLECTION CHARACTERISTICS AT WAVEGUIDE SIDE curve shows the frequency characteristics of the reflection amount of the high frequency signal at Port 1 in FIG. 4. The REFLECTION CHARACTERISTICS AT COAXIAL SIDE curve shows the frequency characteristics of the high frequency signal at Port 2 in FIG. 4.

Port 1 in FIG. 4 corresponds to a waveguide terminal of the first waveguide 102 shown in FIG. 1B. Port 1 designates one end of the electromagnetic field calculation model. Port 1 is arranged in a position which is not affected by a discontinuous site where impedance can vary. The discontinuous site is where the first waveguide 102 connects to coaxial connector 104.

Port 2 in FIG. 4 corresponds to the coaxial connector 104 of first waveguide 102 shown in FIG. 1B and designates the other end of electromagnetic field model. Port 2 is arranged in a position not affected by a discontinuous site where impedance can vary, the discontinuous site being where second waveguide 109 connects to substrate 106.

Figure 6:
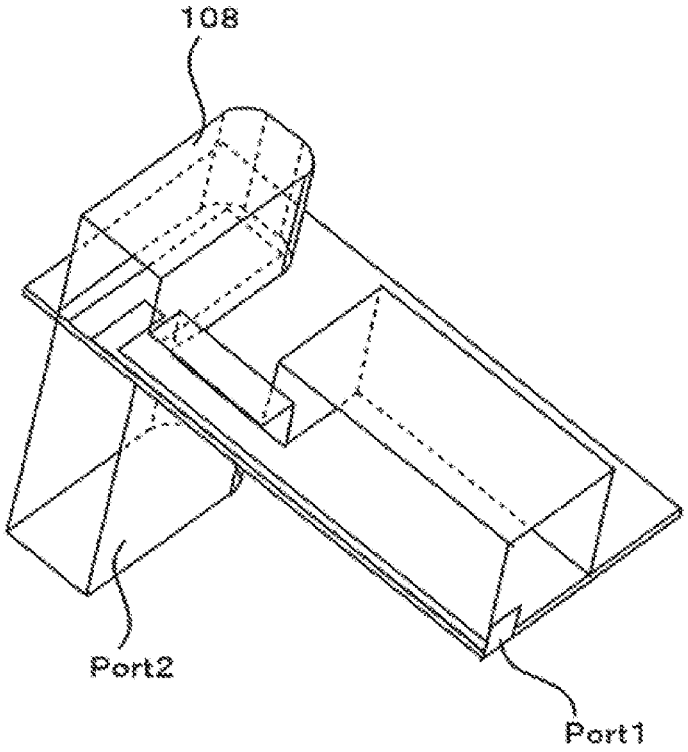
FIG. 6 is a diagram illustrating a simulation model of a waveguide microstrip converter of the coaxial microstrip line conversion circuit according to the first embodiment of the present disclosure.
Figure 7:
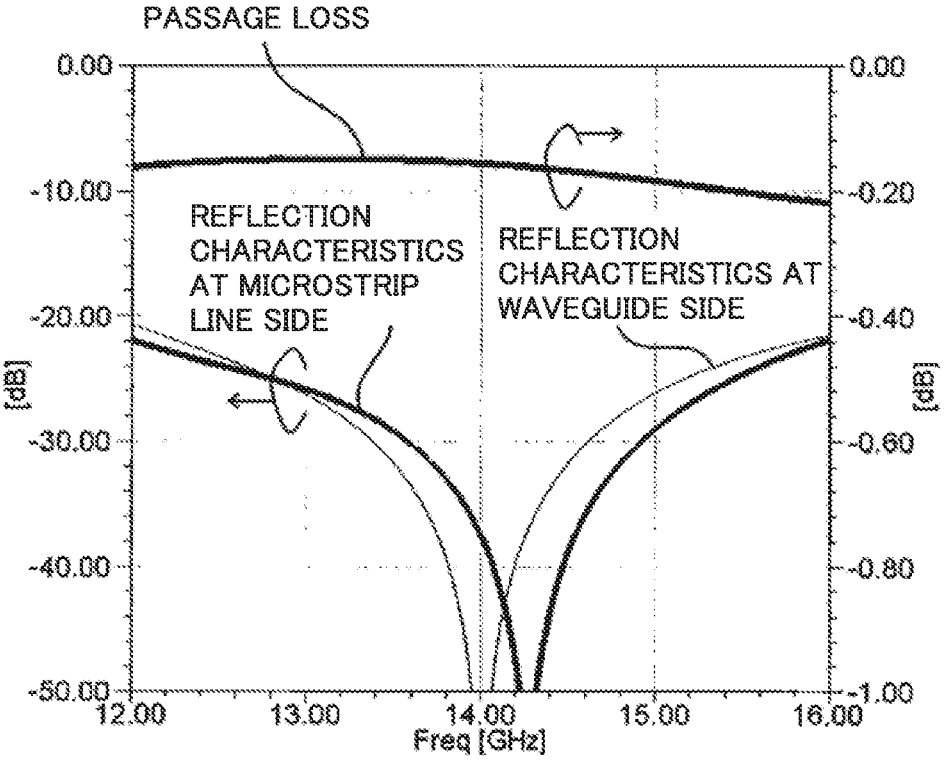
FIG. 7 is a diagram illustrating simulation results of the simulation model of FIG. 6.

FIGS. 6 and 7 show an electromagnetic field calculation model of waveguide-microstrip line converter 2 of FIG. 1 and calculation results. FIG. 6 is a diagram illustrating a simulation model of the waveguide microstrip converter of the coaxial microstrip line conversion circuit according to the first embodiment of the present disclosure. Shorting plate 108 is indicated for reference. FIG. 7 is a diagram illustrating simulation results of the simulation model of FIG. 6. In FIG. 6, the electromagnetic field calculation model employs the cross section along B-B' of FIG. 1 as a symmetrical boundary in order to shorten the calculation time. Dimensional data was determined so as to attain favorable reflection characteristics of less than −20 dB within the range of between 13.75 GHz and 14.5 GHz. In FIG. 7, the PASSAGE LOSS curve shows the GHz frequency characteristics of the loss amount in dB of the high-frequency signal passing between Port 1 and Port 2 in FIG. 6. The REFLECTION CHARACTERISTICS AT MICROSTRIP LINE SIDE curve shows the frequency characteristics of the reflection amount of the high frequency signal at Port 1 in FIG. 6. The REFLECTION CHARACTERISTICS AT WAVEGUIDE SIDE curve shows the frequency characteristics of the high frequency signal at Port 2 in FIG. 6.

Port 1 in FIG. 6 corresponds to one end of strip line 113 in the internal space 110. Port 1 designates one end of the electromagnetic field calculation model. Port 1 is arranged in a position which is not affected by a discontinuous site where impedance can vary. The discontinuous site is where the second waveguide 109 is connected to the other end of strip line 113.

Port 2 in FIG. 6 designates the other end of electromagnetic field model. Port 2 is arranged in a position not affected by a discontinuous site where impedance can vary, the discontinuous site being where second waveguide 109 connects to substrate 106.

Figure 8:
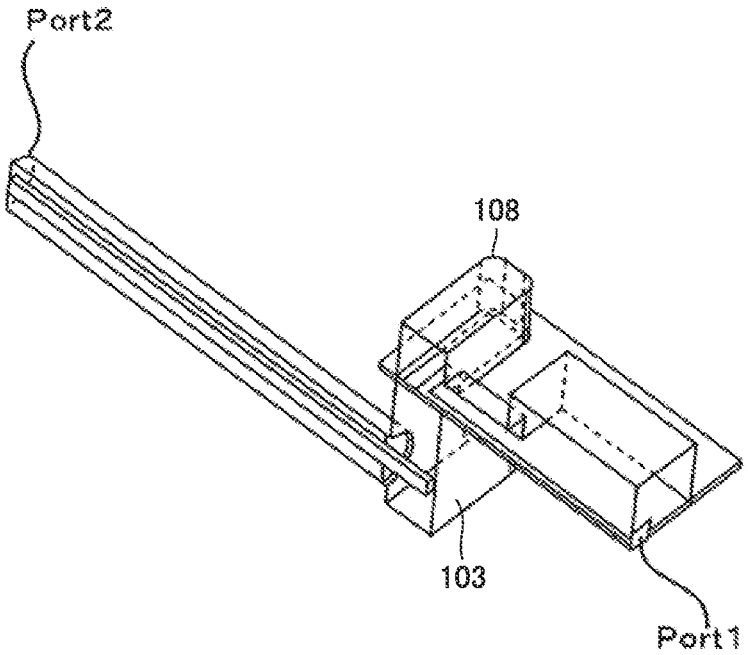
FIG. 8 is a diagram illustrating a simulation model of the coaxial microstrip line conversion circuit according to the first embodiment of the present disclosure.
Figure 9:
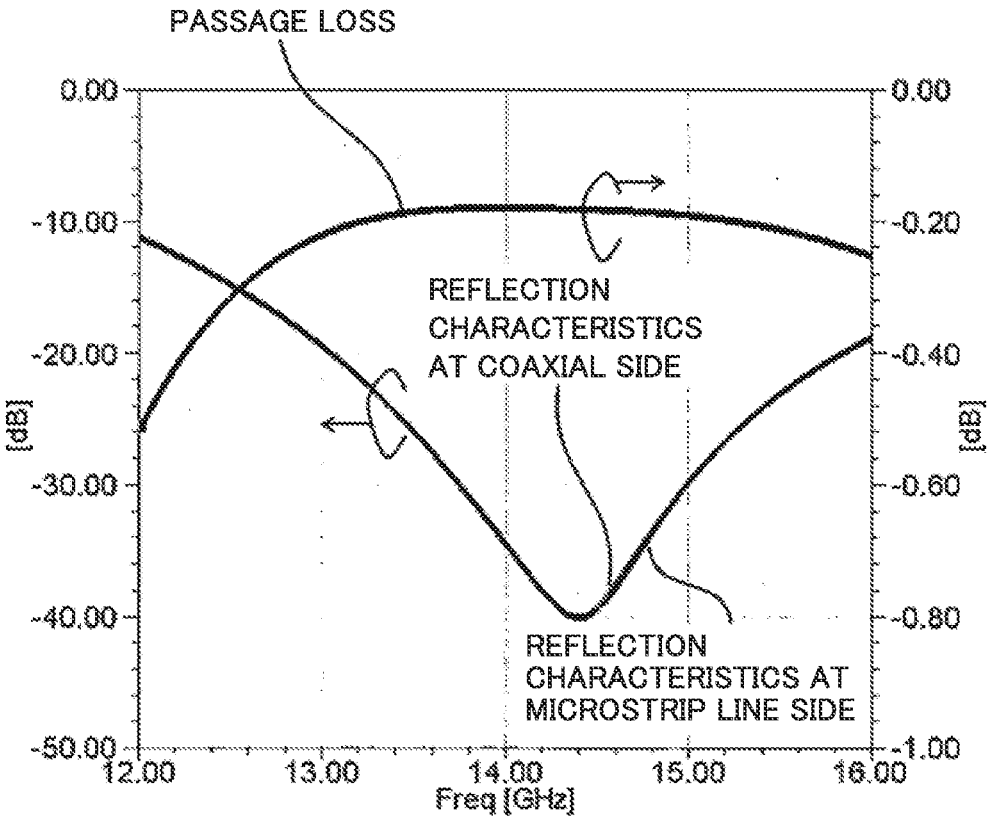
FIG. 9 is a diagram illustrating simulation results of the simulation model of FIG. 8.

Next, FIGS. 8 and 9 show an electromagnetic field calculation model of the first embodiment that combines the models of FIGS. 4 and 6 and calculation results. FIG. 8 is a diagram illustrating a simulation model of the coaxial microstrip line conversion circuit according to the first embodiment of the present disclosure. Shorting plates 103 and 108 are indicated for reference. FIG. 8 illustrates the electromagnetic field calculation model of the microstrip line conversion circuit of FIGS. 1A and 1B. FIG. 8 illustrates the magnetic field model obtained by connecting Port 1 in FIG. 4 to Port 2 in FIG. 6. Port 1 indicates one end of the electromagnetic field calculation model and corresponds to Port 1 in FIG. 6. Port 2 indicates the other end of the electromagnetic field calculation model and corresponds to Port 2 in FIG. 4.

FIG. 9 is a diagram illustrating simulation results of the simulation model of FIG. 8. In FIG. 8, the electromagnetic field calculation model employs the cross section along B-B' of FIG. 1 as a symmetrical boundary in order to shorten the calculation time. Dimensional data of each component remains unchanged from FIGS. 4 and 6, and a distance h (FIG. 1B) between the center of central conductor 112 and signal line 113 of substrate 106 having the microstrip line is set to 7 mm as shown in FIG. 1. Distance h may be greater or smaller than 7 mm. However, in a situation where coaxial line-waveguide converter 1 and waveguide-microstrip line converter 2 are separately designed and combined without change, if h is too small, then an electromagnetic field distribution converted from a coaxial transmission mode (TEM mode) to a TE mode of the waveguide and an electromagnetic field distribution converted from the TE mode of the waveguide to the transmission mode of the microstrip line (TEM mode) interfere with each other, resulting in disturbed distributions to deteriorate the reflection characteristics. For this reason, $h>\lambda/4$ is desired. Here, $\lambda$ represents the wavelength of a transmission frequency.

In FIG. 9, the PASSAGE LOSS curve shows the GHz frequency characteristics of the loss amount in dB of the high-frequency signal passing between Port 1 and Port 2 in FIG. 8. The REFLECTION CHARACTERISTICS AT MICROSTRIP LINE SIDE curve shows the frequency characteristics of the reflection amount of the high frequency signal at Port 1 in FIG. 8. The REFLECTION CHARACTERISTICS AT COAXIAL SIDE curve shows the frequency characteristics of the high frequency signal at Port 2 in FIG. 8.

In this manner as relating to FIG. 1, central conductor 112 of coaxial connector 104 and signal line 113 of substrate 106 having the microstrip line are not mechanically connected, and central conductor 112 of coaxial connector 104 and signal line 113 of substrate 106 having the microstrip line are free from each other with respect to contraction and expansion due to temperature change of coaxial connector 104 and substrate 106 having the microstrip line. Accordingly, with respect to the contraction and expansion due to temperature change of coaxial connector 104 and substrate 106 having the microstrip line, stress is not produced between central conductor 112 of coaxial connector 104 and signal line 113 of substrate 106 having the microstrip line, so that a mechanical breakage such as disconnection does not occur, thereby realizing a reliable conversion circuit between a coaxial line and a microstrip line.

In addition, since microstrip line insertion hole 111 serving as the second through hole which will be a gap is structured to have such a dimension as to cut off a used frequency, unnecessary leakage of a high-frequency signal from an amplifier provided in electronic device internal space 110 to this coaxial microstrip line conversion circuit can be prevented.

Second Embodiment

Figure 10A:
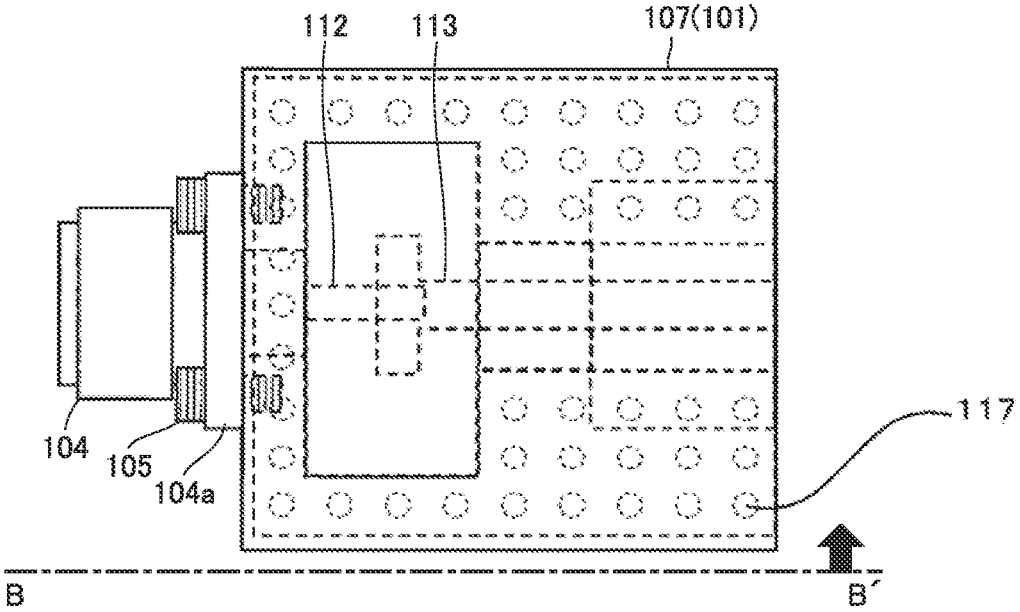
FIG. 10A is a top view of a coaxial microstrip line conversion circuit according to a second embodiment of the present disclosure.

A second embodiment of the present disclosure will be described using FIG. 10. FIG. 10 is a diagram illustrating the configuration of a coaxial microstrip line conversion circuit according to the second embodiment of the present disclosure. In FIG. 10, FIG. 10A is a top view of the coaxial microstrip line conversion circuit according to the second embodiment of the present disclosure, and FIG. 10B is a side view when viewed from B-B' of FIG. 10A.

Figure 10B:
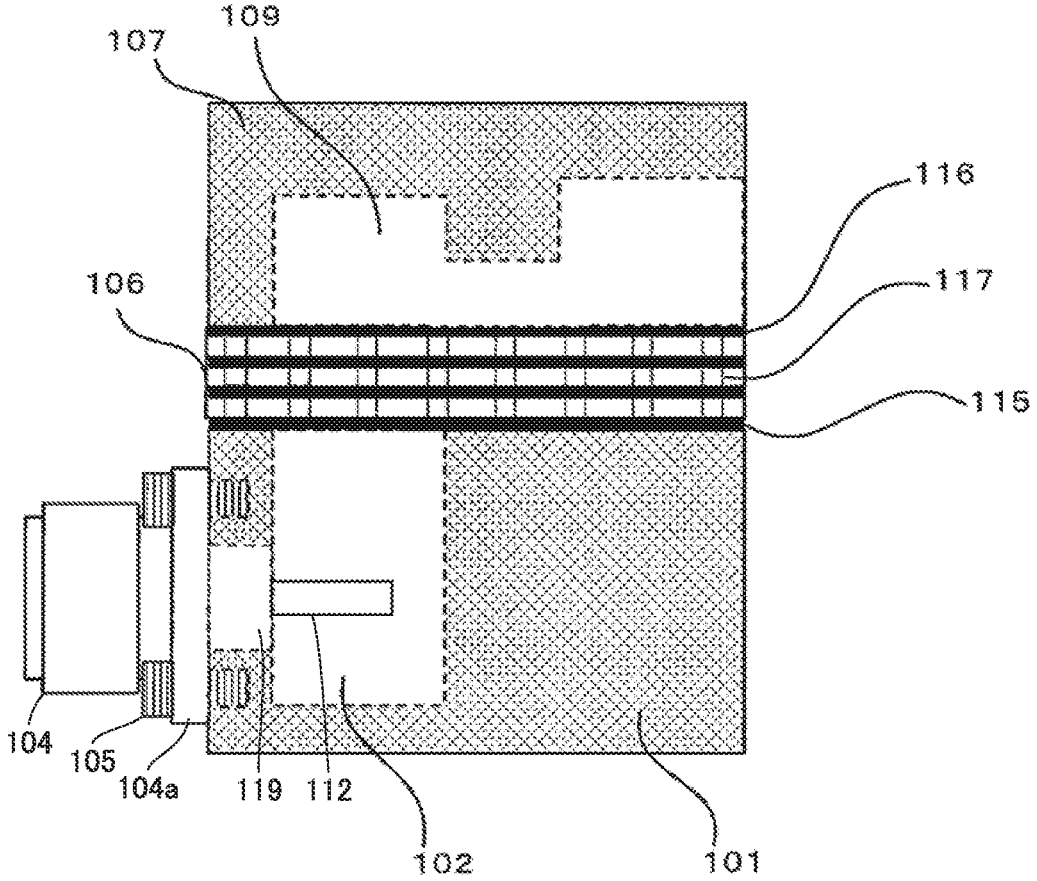
FIG. 10B is a side view when viewed from B-B' of FIG. 10A.

As shown in FIG. 10B, substrate 106 having the microstrip line is characteristically multilayered. In FIGS. 10A and 10B, the same or similar components to those in FIGS. 1 to 3 are designated by the same reference characters and description thereof is omitted.

As shown in FIG. 10B, ground conductor 115 of substrate 106 having the microstrip line and conductor 116 formed on the opposite surface to that of ground conductor 115 are connected by through holes 117. Ground conductor 115 is provided at a portion other than a portion corresponding to the projection of the strip line. Conductor 116 is provided around the signal line formed of the strip line. First waveguide 102 and second waveguide 109 are fixed to each other with substrate 106 interposed therebetween, as shown in FIG. 10B. First waveguide 102 is electrically connected to ground conductor 115, and second waveguide 109 is electrically connected to conductor 116. Accordingly, similarly to the first embodiment of the present disclosure, first housing 101 and second housing 107 are electrically connected, and the space formed by first waveguide 102 and second waveguide 109 serves as an electrically closed space. A similar function and effect to that of the first embodiment is thus produced in this case as well.

Third Embodiment

A third embodiment of the present disclosure will be described using FIG. 11. FIG. 11 is a diagram illustrating the configuration of a coaxial microstrip line conversion circuit according to the third embodiment of the present disclosure.

Figure 11A:
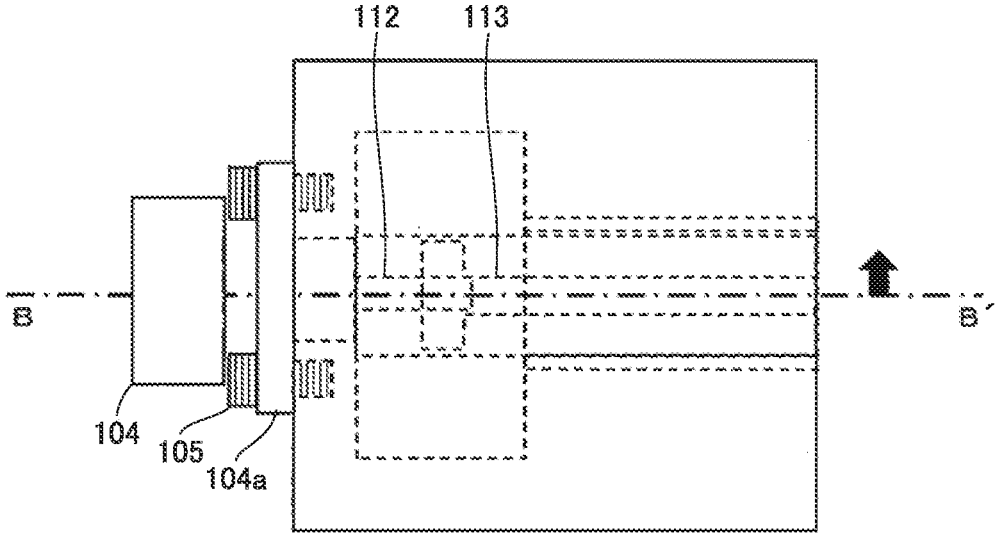
FIG. 11A is a top view of a coaxial microstrip line conversion circuit according to a third embodiment of the present disclosure.
Figure 11B:
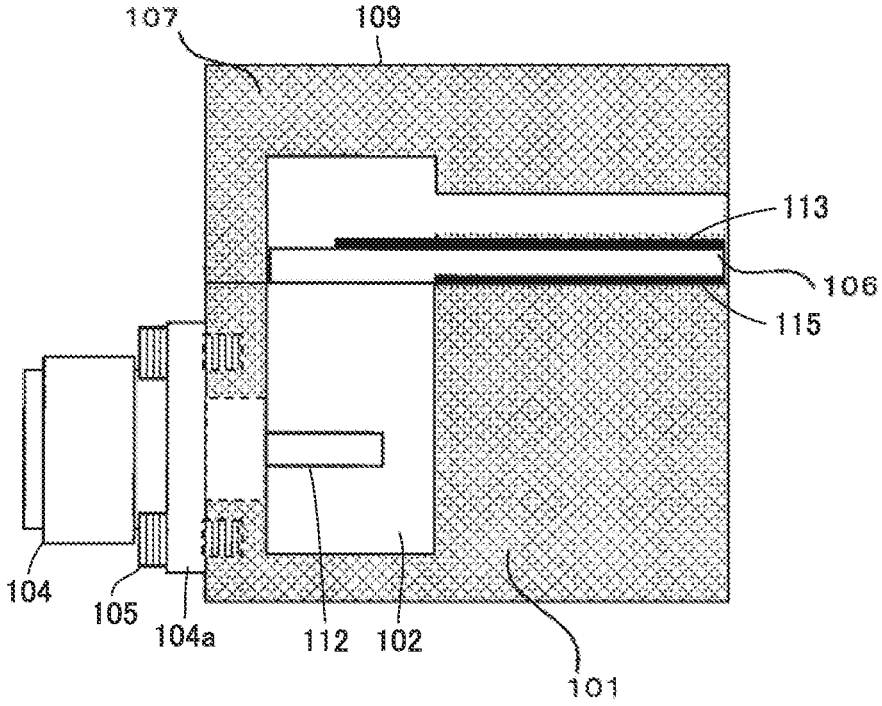
FIG. 11B is a cross-sectional view along B-B' of FIG. 11A.
Figure 12A:
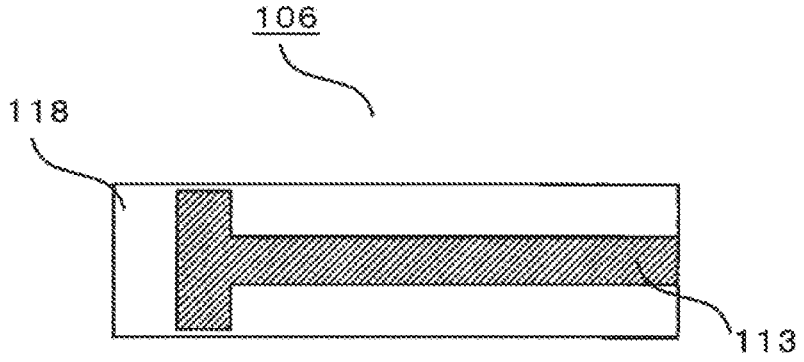
FIG. 12A is a view from above of a substrate having a microstrip line of the third embodiment of the present disclosure.

In FIG. 11, FIG. 11A is a top view of the coaxial microstrip line conversion circuit according to the third embodiment, and FIG. 11B is a cross-sectional view along B-B' of FIG. 11A. FIG. 12 is a diagram illustrating substrate 106 (FIG. 12A) having a microstrip line of the coaxial microstrip line conversion circuit according to the third embodiment of the present disclosure. FIG. 12A is a view from above of the substrate having the microstrip line of the third embodiment, FIG. 12B is a view from the side of the substrate having the microstrip line of the third embodiment, and FIG. 12C is a view from below of the substrate having the microstrip line of the third embodiment.

In FIGS. 11A, 11B and FIGS. 12A, 12B, 12C, the same or similar components to those in FIGS. 1 to 3 are designated by the same reference characters and description thereof is omitted.

Figure 12B:
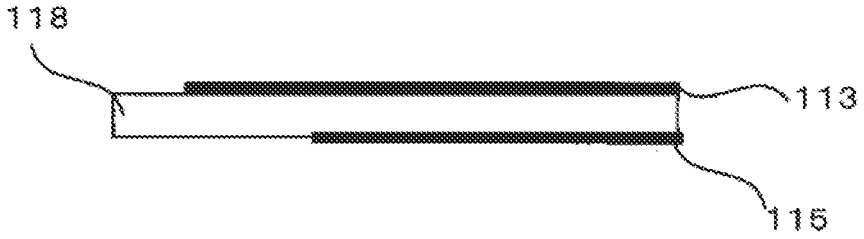
FIG. 12B is a view from the side of the substrate having the microstrip line of the third embodiment of the present disclosure.
Figure 12C:
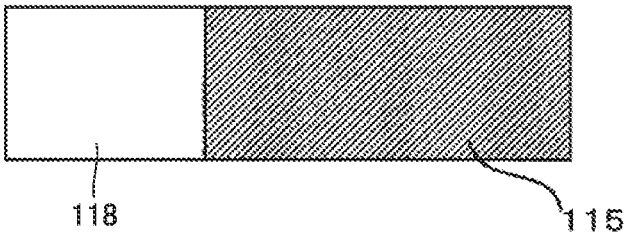
FIG. 12C is a view from below of the substrate having the microstrip line of the third embodiment of the present disclosure.

As shown in FIGS. 11 and 12, substrate 106 (FIGS. 11B and 12A) having the microstrip line of the third embodiment does not have conductor 116 formed on the same plane as signal line 113 (FIGS. 11A, 11B, 12A and 12B), and first housing 101 and second housing 107 are in direct contact with each other without substrate 106 having the microstrip line interposed therebetween. Thus, the electrically connected first housing 101 and second housing 107 are more strongly connected than in the first embodiment of the present disclosure or the second embodiment of the present disclosure. Accordingly, the present embodiment is characterized in that the leakage of the high-frequency signal (electric wave) can be reduced as compared to the first embodiment, while also producing a similar function and effect to that of the first embodiment.

Fourth Embodiment

Figure 13A:
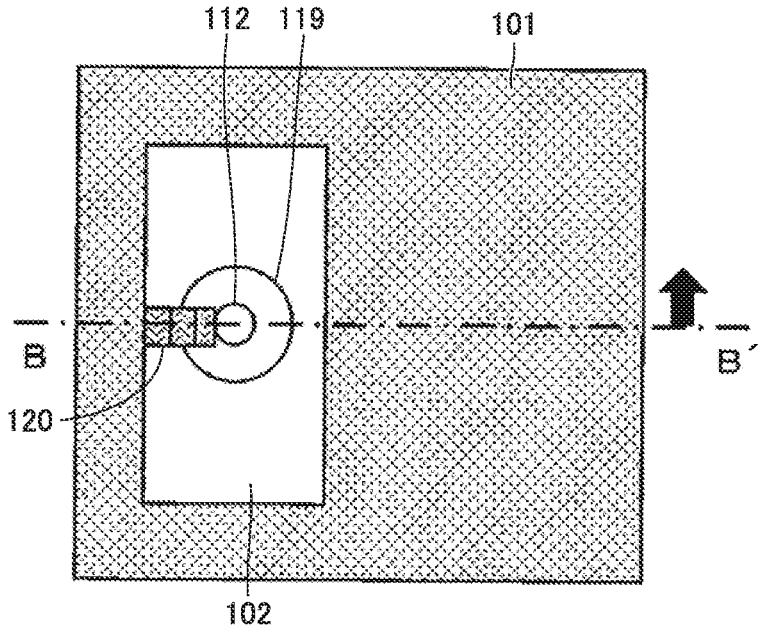
FIG. 13A is a top view of a coaxial microstrip line conversion circuit according to a fourth embodiment of the present disclosure.
Figure 13B:
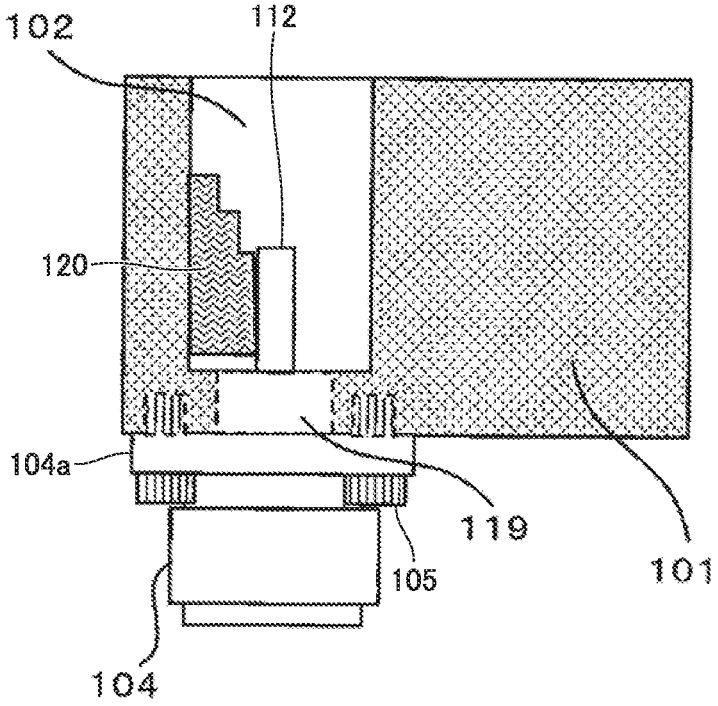
FIG. 13B is a cross-sectional view along B-B' of FIG. 13A.

A fourth embodiment of the present disclosure will be described using FIG. 13. FIG. 13 illustrates an end launch configuration of a coaxial waveguide converter of a coaxial microstrip line conversion circuit according to the fourth embodiment of the present disclosure. FIG. 13A is a top view of the coaxial microstrip line conversion circuit according to the fourth embodiment of the present disclosure, and FIG. 13B is a cross-sectional view along B-B' of FIG. 13A. In FIGS. 13A and 13B, the same or similar components to those in FIGS. 1A and 1B are designated by the same reference characters and description thereof is omitted. FIG. 13B illustrates coaxial connector 104 disposed on a side of first housing 101 parallel to the E plane instead of the H plane of first waveguide 102 in coaxial line-waveguide converter 1 of the first embodiment. A similar function and effect to that of the first embodiment is produced in this case as well. In FIG. 13, a transformer 120 is provided between central conductor 112 and the inner wall of first waveguide 102. Transformer 120 is made of metal, is connected to central conductor 112 and the inner wall of first waveguide 102, and has a shape that decreases in a step-like manner from the tip of central conductor 112. Transformer 120 serves to provide favorable matching characteristics across a wide band between coaxial connector 104 and first waveguide 102.

Fifth Embodiment

Figure 14:
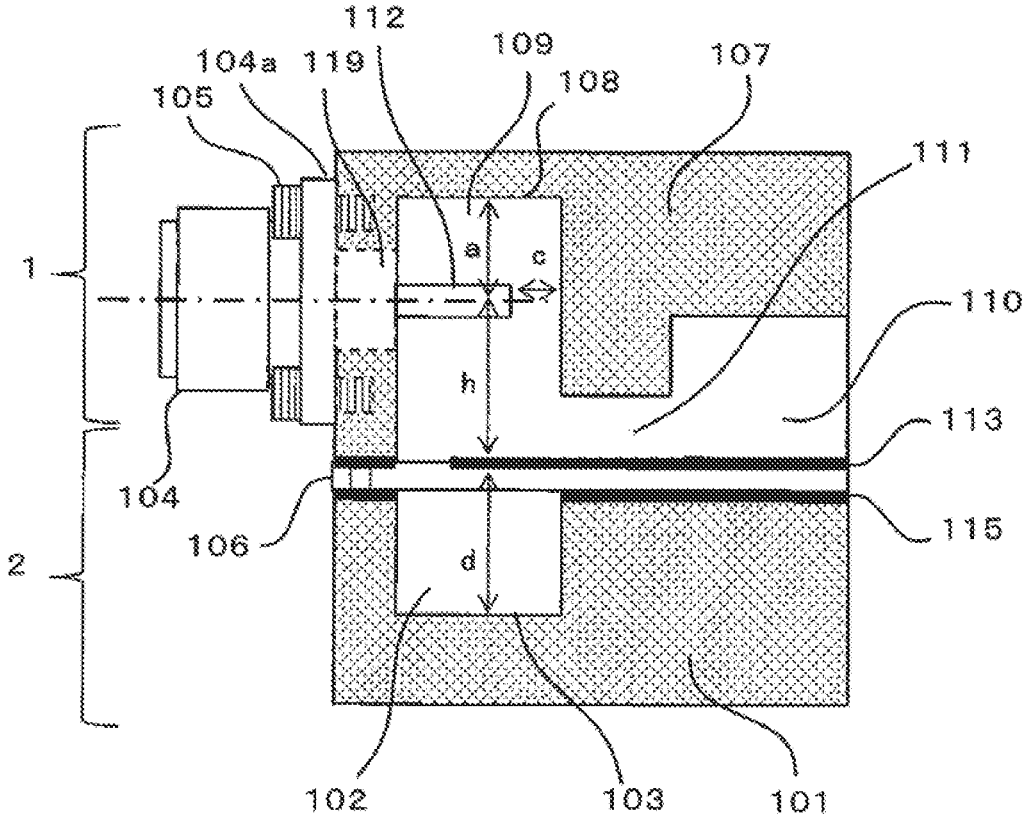
FIG. 14 is a diagram illustrating the configuration of a coaxial microstrip line conversion circuit according to a fifth embodiment of the present disclosure.

A fifth embodiment of the present disclosure will be described using FIG. 14. FIG. 14 is a diagram illustrating the configuration of a coaxial microstrip line conversion circuit according to the fifth embodiment of the present disclosure. In FIG. 14, the same or similar components to those in FIG. 1 are designated by the same reference characters and description thereof is omitted. FIG. 14 is a side view of the fifth embodiment.

In the fifth embodiment, coaxial connector 104 and coaxial connector insertion hole 119 are also provided in second housing 107, and coaxial line—waveguide converter 1 is also provided in second waveguide 109. That is, the fifth embodiment is characterized in that coaxial line—waveguide converter 1 in the first embodiment is at the signal line 113 side of substrate 106 having the microstrip line, and conversely, first waveguide 102 having shorting plate 103 is at the ground conductor 115 side of substrate 106 having the microstrip line.

In the fifth embodiment, a dimensional relationship among a space a between central conductor 112 of coaxial connector 104 and shorting plate 108, a space b (e.g. see FIG. 2B) between a side surface of central conductor 112 and a wall surface of second waveguide 109, and a space c between the tip of central conductor 112 and an inner wall of second waveguide 109 is similar to that of the first embodiment. A space d between signal line 113 and shorting plate 103, and a space h between signal line 113 and central conductor 112 are also similar to those of the first embodiment. A similar function and effect to that of the first embodiment is produced in this fifth embodiment as well.

Sixth Embodiment

Figure 15A:
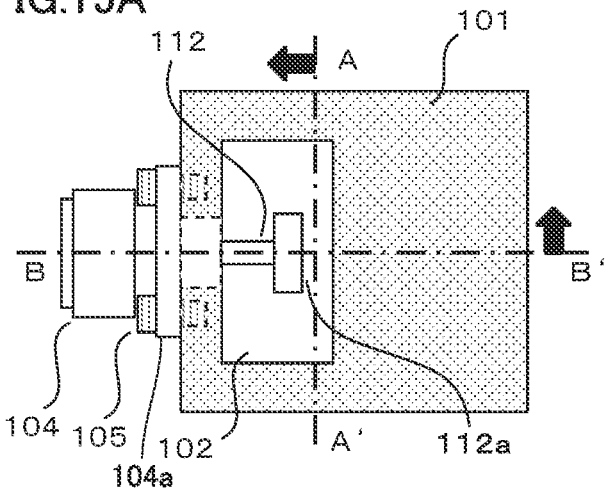
FIG. 15A is a diagram illustrating the configuration of a coaxial waveguide converter of a coaxial microstrip line conversion circuit according to a sixth embodiment of the present disclosure.
Figure 15B:
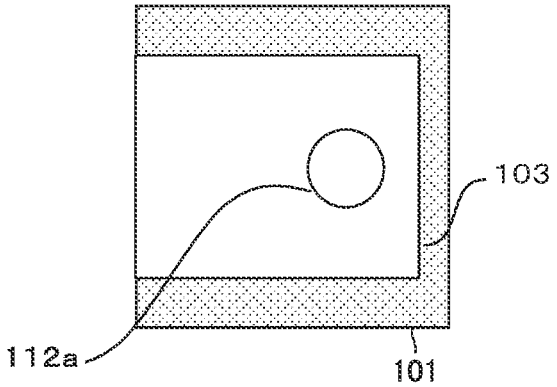
FIG. 15B is a cross-sectional view along A-A' of FIG. 15A.
Figure 15C:
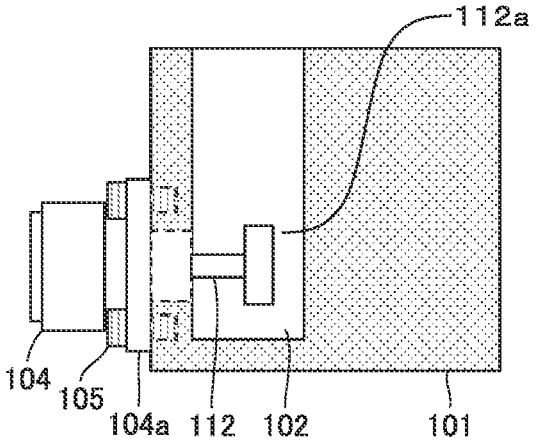
FIG. 15C is a cross-sectional view along B-B' of FIG. 15A.

A sixth embodiment of the present disclosure will be described using FIG. 15. FIG. 15A is a diagram illustrating the configuration of a coaxial waveguide converter of a coaxial microstrip line conversion circuit according to the sixth embodiment of the present disclosure. FIG. 15B is a cross-sectional view along A-A' of FIG. 15A. FIG. 15C is a cross-sectional view along B-B' of FIG. 15A. In FIGS. 15A, 15B and 15C, the same or similar components to those in FIG. 2 are designated by the same reference characters and description thereof is omitted.

In the sixth embodiment, a disc 112*a* having a shape of central conductor 112 (FIGS. 15B and 15C) increased in a radial direction is provided at the tip of the inwardly projecting projection of central conductor 112 of coaxial connector 104 (FIGS. 15A and 15C). Disc 112*a* serves to attain favorable reflection characteristics across a wide band at a frequency used by coaxial connector 104.

It is planned that the embodiments disclosed herein will also be practiced in appropriate combination. It should be understood that the embodiments disclosed herein are illustrative and non-restrictive in every respect. The scope of the present disclosure is defined by the terms of the claims, rather than the description above, and is intended to include any modifications within the scope and meaning equivalent to the terms of the claims.

REFERENCE SIGNS LIST

1 coaxial line-waveguide converter; 2 waveguide-microstrip line converter; 101 first housing; 102 first waveguide; 103 shorting plate; 104*a* flange; 104 coaxial connector; 105 screw; 106 substrate having microstrip line; 107 second housing; 108 shorting plate; 109 second waveguide; 110 electronic device internal space; 111 microstrip line insertion hole (second through hole); 112 central conductor; 113 signal line (strip line); 114 tip of signal line (tip of strip line); 115 ground conductor; 116 conductor; 117 through hole; 118 dielectric substrate; 119 coaxial connector insertion hole (first through hole); 120 transformer.

The invention claimed is:

1. A coaxial microstrip line conversion circuit, comprising:

a waveguide including a first through hole, and a second through hole spaced apart from the first through hole and having a dimension to provide a cut off frequency for signals propagating therethrough;

a coaxial line including an outer conductor, a central conductor including a projection extending beyond an axial end of the outer conductor, and an insulator provided between the outer conductor and the central conductor; and a microstrip line including a ground conductor provided on one surface of an insulating substrate, and a strip line provided on the other surface of the insulating substrate opposite to the one surface and including a projection extending beyond an edge of the ground conductor, in the coaxial line, the outer conductor being connected to an outer wall of the waveguide, and the projection of the central conductor being inserted through the first through hole into the waveguide, in the microstrip line, the ground conductor being connected to an inner wall of the second through hole, and the projection of the strip line being inserted through the second through hole into the waveguide, and a space between the central conductor and the strip line in a waveguide axis direction being longer than one quarter of a wavelength of the transmission frequency.

2. The coaxial microstrip line conversion circuit according to claim 1, wherein the insulating substrate is a multilayer substrate.

3. The coaxial microstrip line conversion circuit according to claim 1, wherein opposite ends of the waveguide along the waveguide axis direction have a shorting structure.

4. The coaxial microstrip line conversion circuit according to claim 1, wherein a tip of the projection of the strip line is T-shaped.

5. The coaxial microstrip line conversion circuit according to claim 1, further comprising, at a tip of the projection of the central conductor, a disc having a shape of the central conductor that is increased in a radial direction.

6. The coaxial microstrip line conversion circuit according to claim 1, comprising a first housing and a second housing are provided as to be identical to each other in cross-sectional shape when viewed along the waveguide axis direction, wherein, the insulating substrate includes the ground conductor provided on the one surface at a portion other than a portion corresponding to the projection of the strip line, and a second ground conductor provided on the other surface around the strip line to be electrically connected to the ground conductor, and the first housing is electrically connected to the ground conductor, the second housing is electrically connected to the second ground conductor, and the first housing and the second housing are fixed to each other with the insulating substrate interposed therebetween.

7. A coaxial microstrip line conversion circuit, comprising:

a waveguide including a first through hole, and a second through hole spaced apart from the first through hole and having a dimension to provide a cut off frequency for signals propagating therethrough;

a coaxial line including an outer conductor, a central conductor including a projection extending beyond an axial end of the outer conductor, and an insulator provided between the outer conductor and the central conductor; and a microstrip line including a ground conductor provided on one surface of an insulating substrate, and a strip line provided on the other surface of the insulating substrate opposite to the one surface and including a projection extending beyond an edge of the ground conductor, in the coaxial line, the outer conductor being connected to a first outer wall of the waveguide, and the projection of the central conductor being inserted through the first through hole into the waveguide, in the microstrip line, the ground conductor being connected to an inner wall of the second through hole, and the projection of the strip line being inserted through the second through hole into the waveguide, the first through hole being provided in the first outer wall arranged parallel to an E plane of the waveguide, and the second through hole being provided in a second outer wall arranged parallel to an H plane of the waveguide, the coaxial line being arranged in an end launch structure.

8. The coaxial microstrip line conversion circuit according to claim 1, wherein the waveguide comprises first and second housings with the microstrip line sandwiched between the first housing and the second housing.

9. The coaxial microstrip line conversion circuit according to claim 8, wherein the first housing and the second housing are identical to each other in cross-sectional shape when viewed in the waveguide axis direction, the insulating substrate includes the ground conductor provided on the one surface at a portion other than a portion corresponding to the projection of the strip line, and a second ground conductor provided on the other surface around the strip line to be electrically connected to the ground conductor, and the first housing is electrically connected to the ground conductor, the second housing is electrically connected to the second ground conductor, and the first housing and the second housing are fixed to each other with the insulating substrate interposed therebetween.

10. The coaxial microstrip line conversion circuit according to claim 8, further comprising, at a tip of the projection of the central conductor, a disc having a shape of the central conductor that is increased in a radial direction.

11. The coaxial microstrip line conversion circuit according to claim 8, wherein opposite ends of the waveguide along the waveguide axis direction have a shorting structure.

12. The coaxial microstrip line conversion circuit according to claim 8, wherein a tip of the projection of the strip line is T-shaped.

13. The coaxial microstrip line conversion circuit according to claim 7, wherein the insulating substrate is a multilayer substrate.

14. A coaxial microstrip line conversion circuit, comprising:

a waveguide including a first through hole, and a second through hole spaced apart from the first through hole and having a dimension to provide a cut off frequency for signals propagating therethrough;

a coaxial line including an outer conductor, a central conductor including a projection extending beyond an axial end of the outer conductor, and an insulator provided between the outer conductor and the central conductor; and a microstrip line including a ground conductor provided on one surface of an insulating substrate, and a strip line provided on the other surface of the insulating substrate opposite to the one surface and including a projection extending beyond an edge of the ground conductor, in the coaxial line, the outer conductor being connected to an outer wall of the waveguide, and the projection of the central conductor being inserted through the first through hole into the waveguide, in the microstrip line, the ground conductor being connected to an inner wall of the second through hole, and the projection of the strip line being inserted through the second through hole into the waveguide, and both the first through hole and the second through hole being provided in the outer wall arranged parallel to an H plane of the waveguide.

* * * * *